US005918353A

United States Patent [19]

Jacumin

[11] Patent Number: 5,918,353

[45] Date of Patent: Jul. 6, 1999

[54] CONTINUOUS FABRIC DETWISTER

[76] Inventor: Jimmy R. Jacumin, 3690 Miller Bridge Rd., Connelly Springs, N.C. 28612

[21] Appl. No.: 09/199,738

[22] Filed: Nov. 25, 1998

[51] Int. Cl.[6] ..... D06C 3/06

[52] U.S. Cl. ..... 26/71; 57/1 UN

[58] Field of Search ..... 26/71, 80, 85, 26/84, 51, 1, 83, 87; 57/1 UN, 2.3, 2.5, 31

[56] References Cited

U.S. PATENT DOCUMENTS

| | | | |
|---|---|---|---|
| 140,320 | 6/1873 | Tompkins et al. | 26/85 |
| 2,117,603 | 5/1938 | Dungler | 57/1 UN |
| 2,248,962 | 7/1941 | Cook | 57/1 |
| 2,350,071 | 5/1944 | Shields | 26/85 |
| 2,836,012 | 5/1958 | Moorshouse et al. | 57/1 |
| 3,501,818 | 3/1970 | Heitkamp | 26/85 |
| 3,693,336 | 9/1972 | Bassani | 57/1 UN |
| 3,813,862 | 6/1974 | Tsuchida | 57/1 |
| 4,241,570 | 12/1980 | Edinger et al. | 57/1 |
| 4,266,983 | 5/1981 | Laszlo et al | 26/85 |
| 4,286,428 | 9/1981 | Bassani | 57/1 |
| 4,843,669 | 7/1989 | Koch et al. | 26/80 |
| 5,119,646 | 6/1992 | Jacumin | 68/13 |
| 5,271,131 | 12/1993 | Jacumin | 26/87 |
| 5,442,842 | 8/1995 | Nielsen et al. | 26/80 |
| 5,551,133 | 9/1996 | Ferraro | 26/80 |
| 5,666,704 | 9/1997 | Price et al. | 57/1 UN |
| 5,718,107 | 2/1998 | Catallo | 57/1 UN |

FOREIGN PATENT DOCUMENTS

| | | |
|---|---|---|
| 340123 | of 1931 | United Kingdom . |
| 677647 | of 1952 | United Kingdom . |

*Primary Examiner*—Amy Vanatta

[57] ABSTRACT

A fabric detwister comprises a housing with a bi-directional rotating cylinder contained therein. A chain and sprocket or equivalent drive mechanism rotates the cylinder in either direction as needed to remove a twist previously imparted to a continuous, elongated, flaccid fabric. Gutters are positioned on either side of the frame in order to effectively drain fluid squeezed from the fabric by a series of non-powered and powered rollers. Air jets positioned proximate the non-powered rollers inflate the fabric causing it to impinge upon the interior surface of the cylinder to effectuate proper detwisting.

6 Claims, 3 Drawing Sheets

CONTINUOUS FABRIC DETWISTER

BACKGROUND OF THE INVENTION

1. Field of the Invention

This invention pertains to a device which detwists continuous tubular knit fabric such as when it leaves a bleaching kier or washer.

2. Description of the Prior Art and Objectives of the Invention

The processing of continuous knitted fabrics has seen improvements in recent years in its efforts to keep the fabric free of twists which may hinder or hamper further processing. One such device is that seen in U.S. Pat. No. 5,271,131, ('131) which is herein incorporated by reference. The '131 patent offers a lengthy and well illustrated history of the problems facing the industry. However, the '131 device. is not able to effectively handle larger fabrics with excessive torque. The apparatus according to the current invention is designed to detwist fabrics which cannot be optimally detwisted by the prior art apparatus.

It is thus a further objective of the present invention to provide a detwisting apparatus which incorporates gutters to protect the circular drive mechanism from an abrasive environment thereby increasing the life of the drive components.

It is still a further objective of the present invention to provide a detwisting apparatus which uses a chain and sprocket mechanism to drive a cylinder to detwist a flaccid mass of continuous fabric.

It is another objective to provide a method of detwisting bulky or large fabric which has excessive twist inherent in its construction.

These and other objectives and advantages will become readily apparent to those skilled in the art upon reference to the following detailed description and accompanying drawing figures.

SUMMARY OF THE INVENTION

A fabric detwisting apparatus is presented, having its primary function in the continuous in-line treatment of an elongated mass of flaccid material, especially tubular shaped knitted fabrics undergoing bleaching, dyeing and finishing operations. The detwister itself may be used, but is not so limited, between a bleaching kier and a washer and is usually employed in conjunction with some type of conveyor of elongated tubular flaccid material. Specifically, the detwister comprises a cylinder which is adapted to rotate in either direction dependent upon the direction of twist previously imparted to the material, in combination with a source of compressed gas, such as air, which is directed to the interior of the tubular flaccid material while such material is present within the rotating cylinder. The gas causes the material to expand so as to impinge against the interior wall of the bi-directional rotating cylinder, thereby continuously imparting a twist to the flaccid mass which is opposite to that which previously had been imparted to the material in its construction or by prior handling in the kier or the like. A detwisting effect is thereby achieved on a continuous processing basis sufficient in extent to keep the elongated, flaccid mass from knotting or kinking up during processing, thus rendering the process sought to be carried out more effective than it otherwise would have been.

DETAILED DESCRIPTION OF THE PREFERRED EMBODIMENT AND OPERATION OF THE INVENTION

Figure 1:
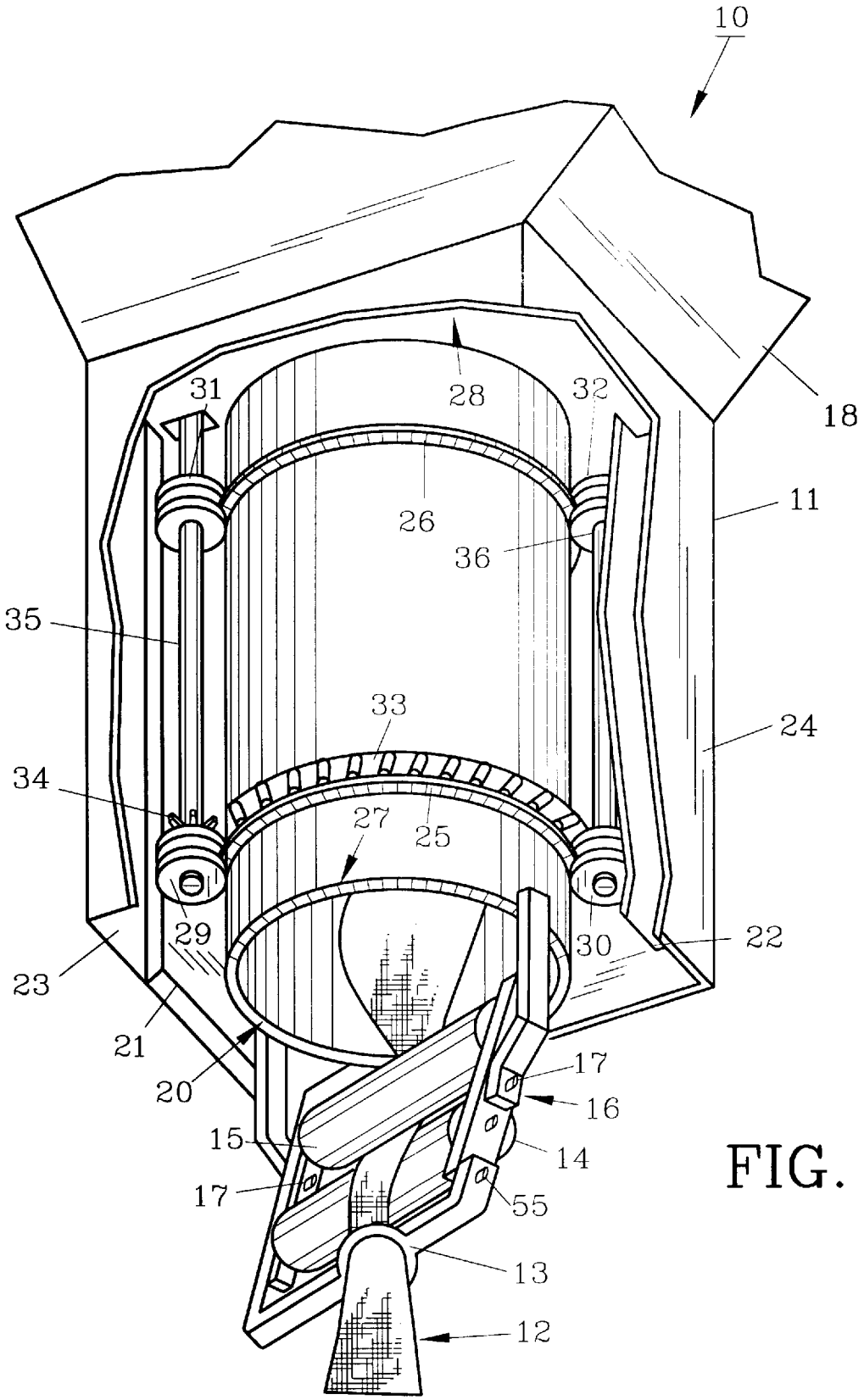
FIG. 1 shows a perspective view taken from beneath a preferred embodiment of the invention which is cut away to reveal drive means for rotation of the cylinder.

Turning now to the drawings, specifically FIG. 1 shows preferred fabric detwisting apparatus or device 10, which comprises rectangular housing or frame 11 attached to funnel 18, partially broken for illustration purposes. Continuous fabric 12 enters circular guide 13 and passes through non-powered rollers 14 and 15 in a sinuous fashion. Guide 13 and non-powered rollers 14 and 15 are adjustably mounted by pins 55 (only one shown) on frame 16 which includes hinge 17 formed by conventional elongate members and pins. Frame 16 is rigidly affixed to cylinder 20 positioned within housing 11. Gutters 21 and 22 are positioned on opposing side walls 23 and 24 respectively. Tracks 25 and 26 circumscribe cylinder 20 proximate opposing ends 27 and 28 respectively. Rollers 29 and 30 are positioned on track 25 while rollers 31 and 32 are positioned on track 26. While two rollers are shown for every rod, it is possible to use only the lower rollers 29 and 31. Additionally, as shown, it appears that cylinder 20 is supported on only a pair of rollers, but in actuality, rollers are positioned at every corner of frame 11 to provide proper support. Chain 33 is proximate track 25 and is driven by sprocket 34. Sprocket 34, rollers 29 and 31 are controlled and driven by rod 35 while rollers 30 and 32 serve as supporting idlers and are connected by rod 36. Other drive mechanisms do exist, such as a rack and pinion drive, a belt drive, a worm gear, a friction drive or other equivalent driving mechanisms. While not shown, a sensor similar to the twist sensor disclosed in the '131 patent or visual observation detects twists in continuous tubular fabric 12 and sends a signal to a motor (also not shown) which reversibly drives sprocket 34 in a direction opposite that of the detected twist. Thus, if the twist sensor detects a clockwise twist or the operator visually detects a twist, the sensor or operator instructs cylinder 20 to rotate counter-clockwise to detwist fabric 12. Conversely, if the twist sensor detects a counter-clockwise twist, the sensor or operator instructs cylinder 20 to rotate clockwise to detwist fabric 12. While a reversible motor is preferred, it is possible to include two uni-directional motors which are separately activated as needed to drive sprocket 34, which turns chain 33 and rotates cylinder 20.

Figure 2:
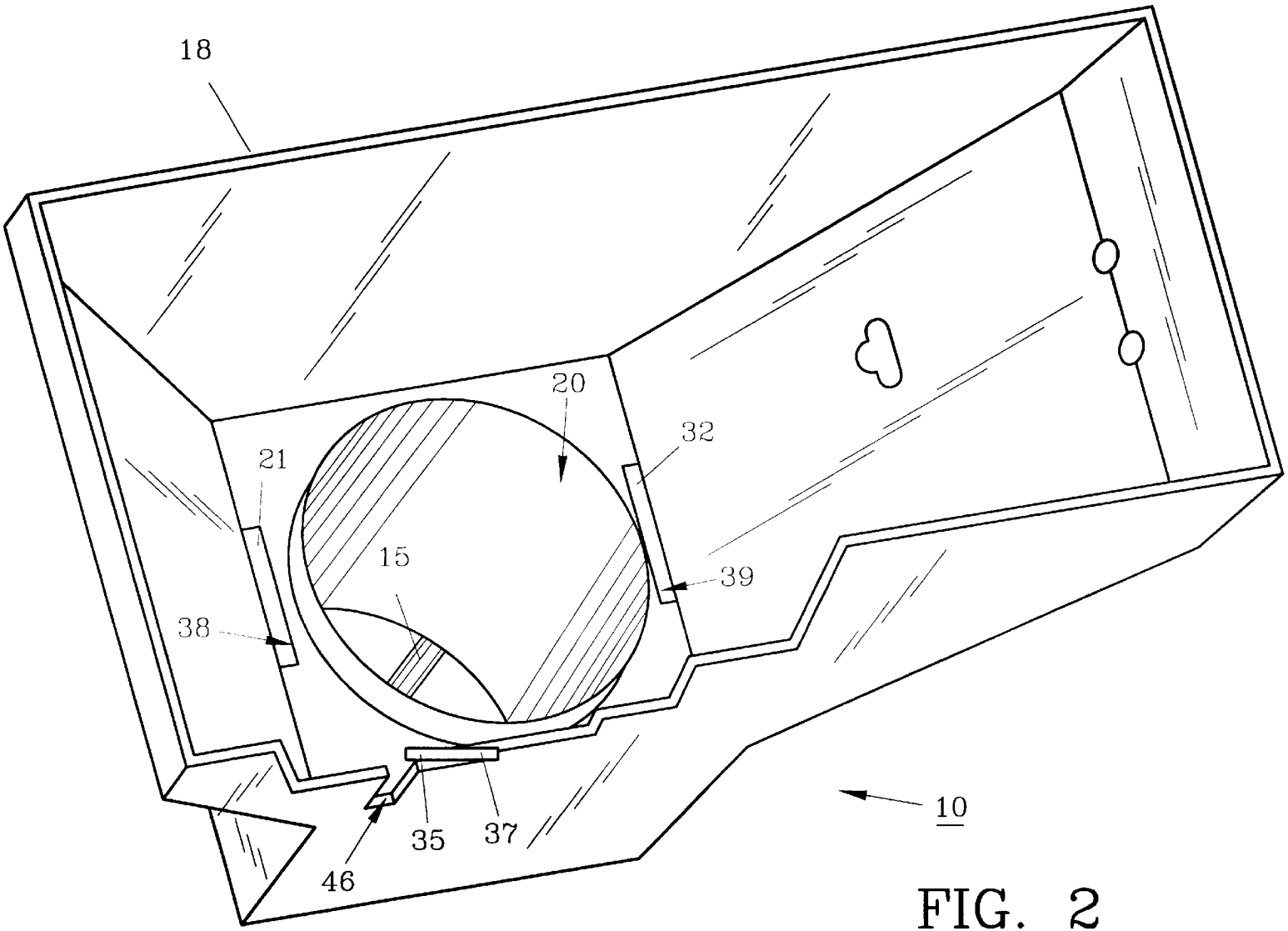
FIG. 2 illustrates a perspective view taken from above the apparatus of FIG. 1, disclosing gutters to route excess fluid away from the drive mechanism.

Gutters 21 and 22 are better seen in FIG. 2 which illustrates gutter openings 38 and 39 for gutters 21 and 22 respectively. Fabric 12 and additional parts discussed below have been removed for clarity in this figure. Gutters 21 and 22 allow water or fluid squeezed from fabric 12 by rollers 40–45 (FIG. 3) to drain downwardly past cylinder 20 and back into the bleaching kier (not shown) or other processing vat without interfering with the drive mechanism associated with cylinder 20. This prevents corrosion and the like and is thus desirable from a preventative maintenance standpoint. Shaft 35 is attached perpendicularly by a universal joint to shaft 37 which allows rotation of cylinder 20 by an operator if such is desired. Shaft 37 is then attached to the motor to drive cylinder 20 as above described. Alternative conventional joints may be used in place of the universal joint.

Figure 3:
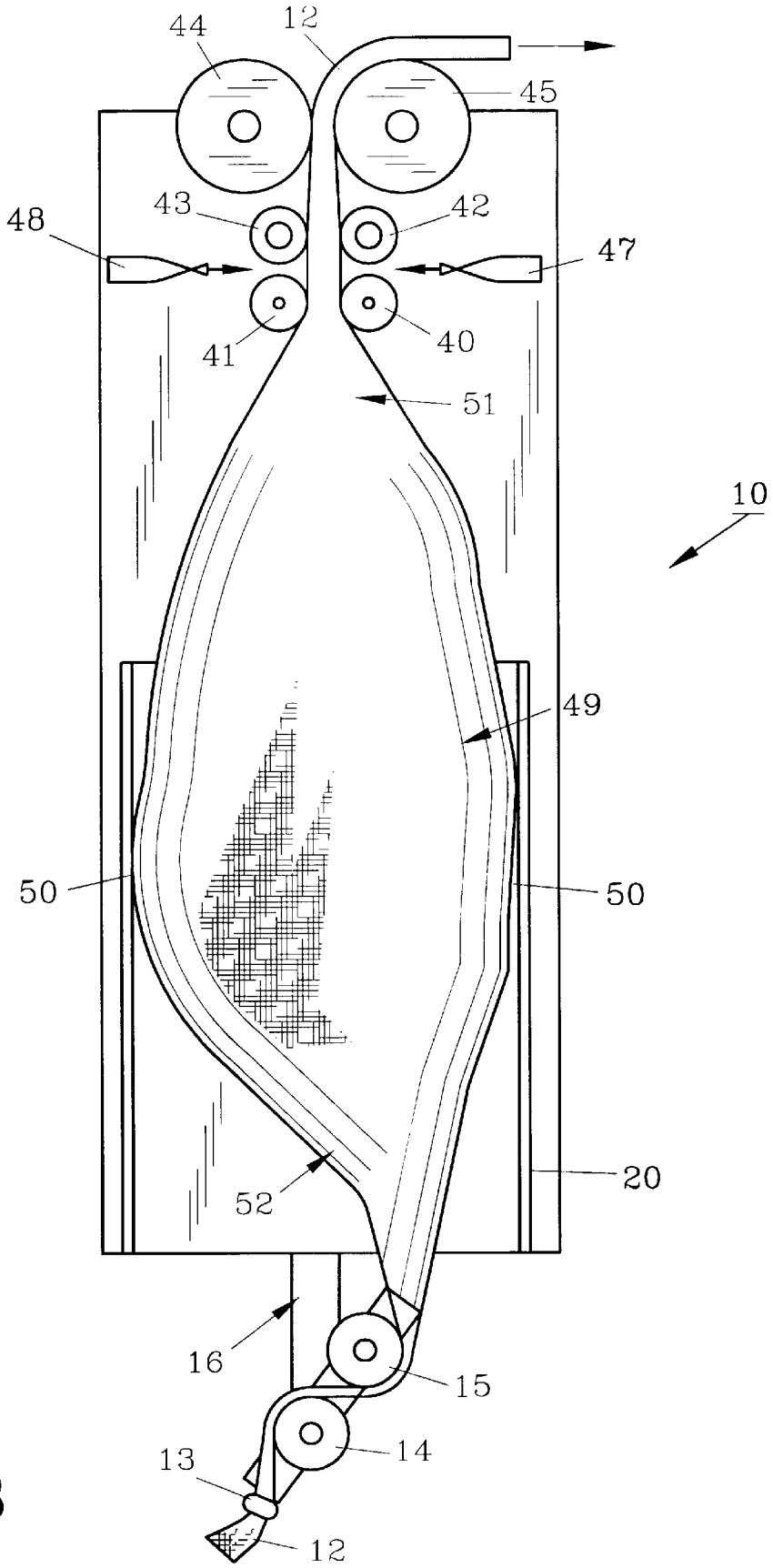
FIG. 3 demonstrates a schematic cross-section of the preferred embodiment of the invention showing the shape taken by the tubular flaccid material during detwisting.

Turning now to FIG. 3, the method of operation of detwisting apparatus 10 is seen in operation. Specifically continuous tubular fabric 12 passes through adjustable guide 13 and adjustable rollers 14 and 15 prior to entering cylinder 20. Air is forced into continuous fabric 12 by conventional air jets 47 and 48, thus inflating fabric 12 into balloon 49 which presses against inner surface 50 of cylinder 20. As cylinder 20 rotates, balloon 49 presses against inner surface 50, which also rotates allowing fabric 12 to be detwisted. Rollers 40–43 are non-powered rollers which limit the size of balloon 49 on downstream end 51 and help to inject air as well as reducing the possibility of edge distortion. It should be noted that non-powered rollers 14 and 15 also limit the size of balloon 49, but from upstream end 52, providing continuous trapping of the air between rollers 14–15 and 44–45. Rollers 14–15 further prevent air from going back through fabric 12 into the bleaching kier which would hamper the continuous movement of fabric 12. In the event air is passing through rollers 14–15 and entering the bleaching kier, rollers 14–15 and guide 13 may be repositioned on pins 55 to effectively cut off air passing therethrough. Powered rollers 44 and 45 provide the motive force to pull fabric 12 through detwisting apparatus 10 and further squeeze fluid from fabric 12 for disposal through gutters 21 and 22.

The preceding recitation is provided as an example of the preferred embodiment and is not meant to limit the nature of scope of the present invention or appended claims.

I claim:

1. Apparatus for continuously detwisting tubular-shaped elongated flaccid material, said apparatus comprising:

a) a housing;

b) a cylinder, said cylinder mounted on said housing, said cylinder for rotation of the elongated flaccid material, said cylinder comprising an upstream end and a downstream end;

c) a driving device engaging said cylinder to impart rotation thereto; and d) a device for supplying pressurized gas into the tubular-shaped flaccid material while the material moves in its direction of travel through the interior of said cylinder, thereby expanding the material to impinge against said cylinder to impart twist to said material in the direction of rotation of said cylinder thereby detwisting the material.

2. The apparatus of claim 1, further comprising at least one gutter, said gutter within said housing for carrying off excess fluid from the material, said driving device spaced from said gutter.

3. The apparatus of claim 1, further comprising a pair of non-powered rollers, said rollers proximate said cylinder on the upstream end of said cylinder.

4. The apparatus of claim 1, wherein said driving device comprises a chain, said chain affixed to the exterior of said cylinder and a sprocket, said sprocket engaging said chain.

5. The apparatus of claim 1 further comprising a pair of powered rollers, said powered rollers proximate said cylinder on the downstream end of said cylinder.

6. The apparatus of claim 1, further comprising a guide, said guide positioned proximate said cylinder on the upstream end of said cylinder.

* * * * *